United States Patent [19]

Dragisic

[11] 4,164,812

[45] Aug. 21, 1979

[54] TERMINATION TOOL FOR ASSEMBLING ELECTRICAL CABLES TO CONNECTORS

[75] Inventor: Joseph Dragisic, Cicero, Ill.

[73] Assignee: Bunker Ramo Corporation, Oak Brook, Ill.

[21] Appl. No.: 941,518

[22] Filed: Sep. 11, 1978

[51] Int. Cl.[2] ..... H01R 43/04

[52] U.S. Cl. ..... 29/749; 29/753; 29/760

[58] Field of Search ..... 29/749, 751, 753, 759, 29/760, 566.3, 566.4

[56] References Cited

U.S. PATENT DOCUMENTS 4,035,897 7/1977 Over et al. ..... 29/749 X

*Primary Examiner*—Carl E. Hall

*Attorney, Agent, or Firm*—William Lohff; F. M. Arbuckle

[57] ABSTRACT

A termination tool is disclosed for assembling electrical cables, such as ribbon cables or the like, to an electrical connector which has receptacle means for receiving a cable in electrical termination with conductive contacts on the connector. The tool includes a base having a locator portion for properly locating a connector in position for receiving an electrical cable. A pair of spaced opposed clamping jaws are pivotally mounted on the base on opposite sides of the connector locator for movement toward and away from each other to engage a properly positioned connector to hold the connector in position during a termination operation. The clamping jaws are spring loaded and biased outwardly toward inoperative positions whereby a connector can be easily located therebetween. A reciprocally mounted stuffer means is mounted on the tool for movement toward and away from the base and locator means to drive a cable into the receptacle means of the connector. The stuffer means includes a driving portion for effecting driving of the cable into the receptacle means of the connector and a pair of spaced apart cam portions on opposite sides of the driving portion, the cam portions being canted relative to the direction of movement of the stuffer means for engaging the clamping jaws to move the jaws toward one another into engagement with opposite sides of a properly located connector.

26 Claims, 5 Drawing Figures

TERMINATION TOOL FOR ASSEMBLING ELECTRICAL CABLES TO CONNECTORS

BACKGROUND OF THE INVENTION

This invention relates to a termination or assembling tool for assembling electrical cables such as ribbon cables to an electrical connector which has a receptacle for receiving a cable in electrical termination with conductive contacts on the connector.

Ribbon cables or the like conventionally comprise a plurality of parallel individual cables arranged in a generally flat conformation with the individual cables joined by a thermoplastic webbing. The ribbon cable normally is assembled to an elongated electrical connector which has receptacle means including a plurality of linearly oriented slots or notches for receiving the individual cables of the ribbon cable. The slots or notches are formed in a somewhat rigid thermoplastic insert of the connector which, in turn, is housed in a metal casing. The slots or notches for the cable protrude outwardly from the housing for receiving the ribbon cable and the individual cables thereof. Electrical contacts are associated with each of the individual slots or notches and oftentimes include contact blades which pierce the insulation about the individual cables of the ribbon cable to establish electrical conductivity with the electrical wires of the cables. Although the driving force for piercing by the contact blades through the insulation of a single individual cable is not relatively considerable, it can be seen that the force required to drive the piercing blades of the plurality of contacts through a considerable number of cables of the composite ribbon cable is multiplied considerably and, due to this composite force, the thermoplastic receptacle portion comprising the insert for the electrical connector oftentimes is deformed and, in fact, in some instances does not result in a good connection between the piercing blades of the contacts and the electrical conductors of the cables.

This invention is directed to a new and improved termination hand tool of the characteric described which is very simple and efficient in operation while eliminating the problems referred to above.

SUMMARY OF THE INVENTION

An object of the present invention is to provide a new and improved termination tool for assembling electrical cables, such as ribbon cables or the like, to an electrical connector which has receptacle means for receiving a cable in electrical termination with conductive contacts on the connector.

A further object of the invention is to provide a termination tool of the character described for terminating ribbon cables or the like in an electrical connector having receptacle means in the form of a plurality of linearly oriented notches or slots for receiving the individual cables of the ribbon connector.

Another object of the invention is to provide a termination tool of the character described for assembling ribbon type electrical cables to an electrical connector and for terminating the individual cables of the ribbon cable with conductive contacts on the connector in a single termination operation.

These and other objects of the invention are achieved by providing a terminal tool which includes a base having an upstanding locator block provided with a trough-like receptacle for positioning the housing of an electrical connector of the character described, so that the thermoplastic insert portion of the connector faces generally upwardly with the notches or slots of teconnector for receiving the individual cables of the ribbon cable faced outwardly in a generally transverse or horizontal direction. A pair of spring loaded clamping jaws are pivotally mounted on the base on opposite sides of the connector locator block and are biased outwardly by the spring to respective inoperative positions defined by a pair of upstanding stop pins on the base. The clamping jaws are thus movable generally horizontal toward one another about their pivot connections on the base against the spring bias so as to engage the upstanding connector and provide lateral support for the upstanding thermoplastic receiving the connector of the connector during a termination operation. The spring automatically returns the clamping jaws to their inoperative positions after a termination operation.

Stuffer means is mounted on the tool for generally vertical reciprocal movement toward and away from the base and locator means thereof to drive a composite ribbon cable into the receptacle means of the connector, which is properly positioned on the locator base. The stuffer means includes a central driving portion for driving the cable into the receptacle means of the connector and a pair of depending cam arms on opposite sides of the central stuffer portion for engaging the outside of the clamping jaws and camming the clamping jaws against the spring bias thereof inwardly in a direction generally perpendicular to the vertical movement of the stuffer means to move the clamping jaws and provide lateral support for the connector during a terminal operation. The cam arms of the stuffer means have inwardly facing canted cam surfaces to facilitate converting the vertical movement and corresponding vertical forces of the stuffer means into horizontal transverse movement of the clamping jaws.

Other objects, features, and advantages of the invention will be apparent from the following detailed description taken in connection with the accompanying drawings.

DETAILED DESCRIPTION OF THE INVENTION

Figure 1:
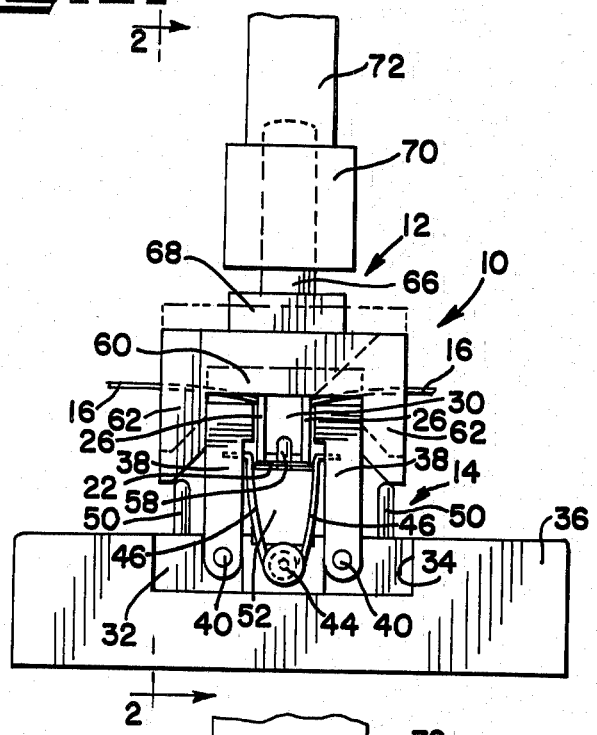
FIG. 1 is a fragmented, side elevational view of the termination tool of the present invention.

Referring to the drawings in greater detail, the invention is disclosed herein in the form of a termination tool, generally designated 10 (FIG. 1), which includes an upper stuffer means or driving head, generally designated 12, and a lower base and clamping means, generally designated 14. The clamping means will be described in greater detail hereinafter. The termination tool is provided for assembling electrical cables, such as ribbon cables 16 (FIG. 5) or the like, to an electrical connector which has receptacle means for receiving a cable in electrical termination with conductive contacts on the connector.

Figure 5:
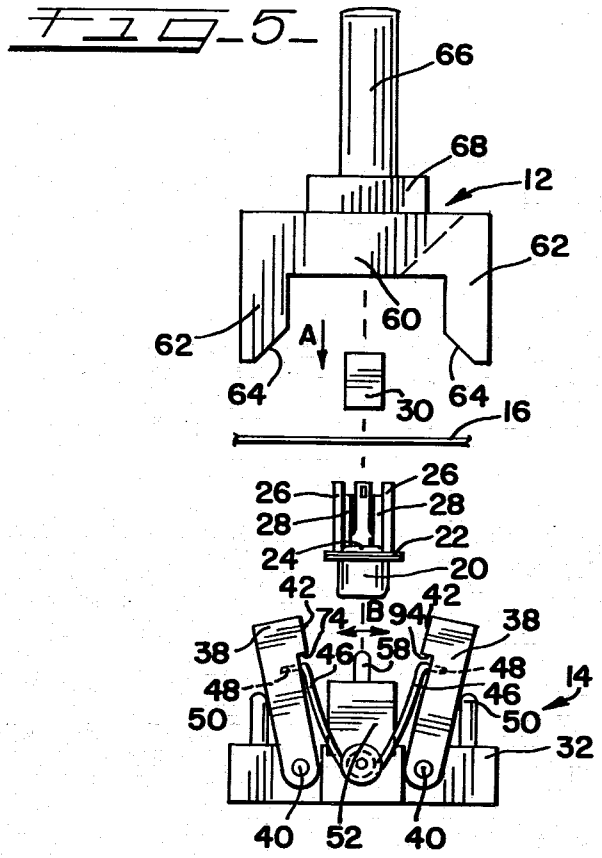
FIG. 5 is an exploded side perspective view of the stuffer means, connector components, ribbon cable, and clamping jaws prior to a termination operation.

The electrical connector itself is shown best in FIG. 5 and includes a lower portion (as viewed in the drawings) having a metal housing or casing 20 with an outwardly protruding peripheral flange 22. A dielectric insert 24 is fixed within the housing 20 and includes a linear series of upwardly protruding fingers 26 along the longitudinal side of the insert which define slots or notches between which the individual cables of the ribbon cable 16 are positioned during a termination operation. The dielectric insert of the connector has a plurality of electrical contacts 28 assembled to or embedded in the insert generally in alignment with the notches or slots between the fingers 26. Each contact has one or more piercing blades which, as known in the art, are adapted to pierce the insulative covering about the electric wires of each individual cable of the composite ribbon cable 16 to establish electrical conductivity therewith. The connector also includes a stuffer block 30 (FIG. 5) which is driven downwardly in the direction of arrow A by the stuffer means 12 as described hereinafter so that the stuffer block 30 drives the ribbon cable 16 into the connector between the fingers 26 thereof during a termination operation. Thus, it can be seen that receptacle means are provided by the fingers 26 of the electrical connector for receiving the ribbon cable 16 and the stuffer block 30. The stuffer block remains in position between the fingers 26 of the connector after a termination operation holding the ribbon cable conductively terminated with the contacts of the connector. Such a termination operation is commonly referred to as an in-line termination whereby the connector contacts are conductively connected to the individual cables of the composite ribbon cable intermediate the ends of the ribbon cable.

Figure 2:
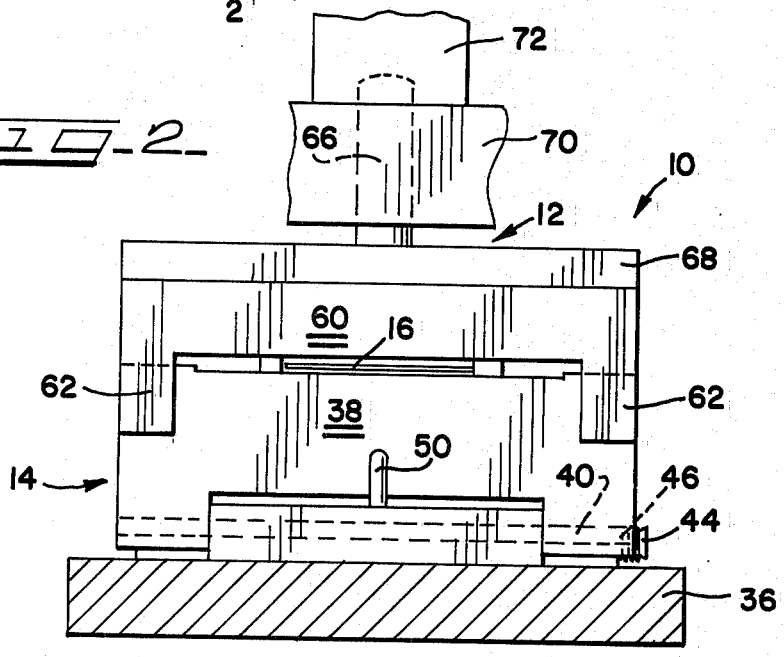
FIG. 2 is a fragmented, side elevational view looking generally in the direction of arrows 2—2 of FIG. 1.
Figure 3:
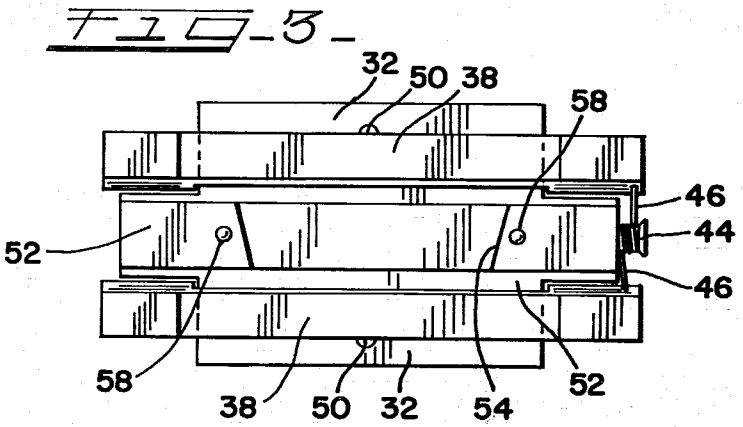
FIG. 3 is a top plan view looking downwardly onto the top of the base and connector locator and clamping jaws prior to positioning an electrical connector therein.
Figure 4:
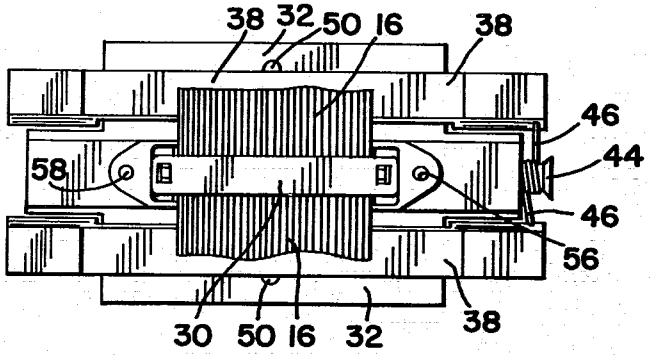
FIG. 4 is a top plan view similar to that of FIG. 3, with an electrical connector and fragmented ribbon cable properly positioned in the locator means of the base prior to a termination operation.

The clamping means 14 of the present invention includes a lower mounting block 32 mounted within a recess 34 (FIG. 1) in the top of a base 36 of the tool. The clamping means includes a pair of spaced clamping jaws 38 which are pivotally mounted to the block 32 by pivot shafts 40 (FIGS. 1 and 5) whereby the clamping jaws 38 are movable toward and away from each other generally in the direction of double headed arrow B (FIG. 5) between inoperative positions shown in FIG. 5 to clamping positions shown in FIG. 1. When the clamping jaws 38 are in their clamping positions as shown in FIG. 1, inner clamping surfaces 42 of the clamping jaws engage the outer sides of the fingers 26 of the electrical connector to provide lateral support for the connector during a termination operation. As seen in FIGS. 2 through 4, the clamping jaws 38 extend longitudinally along the termination tool at least the width of the electrical connector when properly positioned for a termination operation.

The clamping jaws 38 are spring loaded by means of a wire spring wrapped about a boss 44 protruding from one end of the mounting block 32 for the clamping jaws, as best seen in FIGS. 3 and 4. The wire spring includes a pair of end portions 46 having tab type extremities 48 (FIG. 5) seated within appropriate holes or apertures on the inside of the clamping jaws. The spring means is effective to bias the clamping jaws 38 outwardly toward their inoperative positions shown in FIG. 5. A pair of pins 50 protrude upwardly from the mounting block 32 to provide stop means which define the inoperative positions of the clamping jaws.

Locator means is provided on the top of the mounting block 32 for receiving and properly positioning an electrical connector for a termination operation. More particularly, an elongated locator block 52 protrudes upwardly from the mounting block 32 for the clamping jaws 38, and the locator block 52 is located generally equidistant between the clamping jaws as best seen in FIG. 5. Referring to FIG. 3, the locator block 52 has a central-trough-like receptacle 54 within which the housing or casing 20 of the connector is positioned. The flange 22 of the connector casing has a pair of holes 56 for receiving a pair of upwardly protruding locator pins 58 disposed on top of the locator block 52.

The stuffer means or head 12 is best shown in FIGS. 1, 2 and 5 and includes a downwardly facing U-shaped member having a central portion 60 for engaging the top of the connector stuffer block 30 to drive the stuffer block downwardly in the direction of arrow A (FIG. 5) to drive the ribbon cable 16 into the electrical connector. A pair of longitudinal cam arms 62 depend downwardly along opposite sides of the central portion 60 and have inwardly directed canted surfaces 64 which are effective during downward or driving movement of the stuffer means to engage the outside of the clamping jaws 38 to drive the clamping jaws inwardly toward each other to engage opposite sides of the electrical connector and provide lateral support for the dielectric fingers 26 of the connector. The stuffer means 12 also includes an upper central shaft 66 protruding upwardly from a mounting block 68 and is fixed within a mounting bracket 70 (FIG. 1) which, in turn, is connected to a conventional pneumatic piston and cylinder device 72. The piston and cylinder device may comprise a double action pistion mechanism or may be spring loaded so as to be effective to selectively drive the stuffer means 12 in a downward direction for a termination operation and cyclically return the stuffer means upwardly to an imoperative position as best shown in FIG. 5 for a next cycle of operation. Of course, gear rack and pinion devices may be employed as well as lever mechanisms or the like to effect the vertical reciprocatory movement of the stuffer means or head 12.

Referring to FIGS. 1 and 5, it should be noted that the clamping jaws 38 are provided with shoulders 74 along the inside thereof which overlie the flange 22 of an electrical connector when properly positioned on the locator block 52 to prevent inadvertent movement of the connector upwardly out of the receptacle or trough 54 in the top of the locator block during a termination operation.

In operation, a user of the termination tool 10 of the present invention, places an electrical connector into the tool by properly positioning the metal housing or casing 20 of the connector within the trough 54 on top of the locator block 52, with the locator pins 58 protruding upwardly through the holes 56 in the flange 22 of the connector. A ribbon cable 16 then is positioned on top of the connector as best seen in FIG. 4 so that the ribbon cable is disposed immediately above the dielectric fingers 26 of the connector. As mentioned above, notches or slots are formed on the connector between the fingers 26 for receiving the individual cables of the ribbon cable. The stuffer block 30 of the composite electrical connector then is positioned on top of the ribbon cable 16 and manually forced downwardly to initially drive the ribbon cable slightly into the connector. The operator then selectively actuates the piston and cylinder device 72 to drive the stuffer means 12 downwardly in the direction of arrow A (FIG. 5) so that the central portion 60 of the stuffer means engages the top of the connector stuffer block 30 and fully drives the ribbon cable 16 into the connector between the fingers 26 whereby the piercing blades of the individual connector contacts pierce and establish electrical conductivity with the electrical wires of the cable. As the stuffer means 12 is driven downwardly in the direction of arrow A (FIG. 5) the cam surfaces 64 along the inside and bottom of the cam arms 62 engage the outer sides of the clamping jaws 38 to move the jaws inwardly toward each other to engage and provide lateral support for the fingers 26 of the connector. It should be noted that the cam arms 62 are of sufficient length that the cam surfaces 64 engage the clamping jaws and move the clamping jaws inwardly against the connector fingers 26 before the central porition 60 of the stuffer means engages the stuffer block 30 of the connector so that full support is provided for the connector fingers 26 before the full force of the termination operation becomes effective. This is important so that sound electrical contact is established between the piercing blades of the electrical contacts. As stated above, the combined forces necessary to drive a plurality of contact piercing blades through the insulation about the electrical wires of the cables is relatively considerable and could cause outward deflection of the dielectric connector fingers 26 which conventionally are fabricated of thermoplastic material or the like. It can be seen that any outward deflection of the dielectric fingers 26 during a termination operation is eliminated by the lateral support provided by the clamping jaws 38.

While in the foregoing specification a detailed description of the invention has been set forth for purposes of illustration, the details herein given may be varied by those skilled in the art without departing from the spirit and scope of the invention.

I claim:

1. A termination tool for assembling electrical cables, such as ribbon cables or the like, to an electrical connector which has receptacle means for receiving a cable in electrical termination with conductive contacts on the connector, comprising:

a base having locator means for properly locating a connector in position for receiving an electrical cable;

clamping means movably mounted on said base for engaging a properly positioned connector to hold the connector in position during a termination operation;

stuffer means mounted on the tool for movement toward and away from said base and locator means to drive a cable into the receptacle means of the connector; and said stuffer means including means for effecting movement of said clamping means into engagement with the connector in response to the stuffer means being moved to drive the cable into the receptacle means of the connector.

2. The termination tool of claim 1 wherein said clamping means is mounted on the base by means providing for movement of the clamping means toward and away from a properly located connector in a direction generally transverse to the direction of movement of said stuffer means thereby providing lateral support for the connector during a termination operation.

3. The termination tool of claim 2 wherein said clamping means is spring loaded and is moved by said stuffer means toward a properly located connector against the spring bias for a termination operation and is automatically returned to an inoperative position by the spring after the termination operation.

4. The termination tool of claim 3 including stop means for the clamping means defining said inoperative position.

5. The termination tool of claim 2 wherein said clamping means includes a pair of opposed clamping jaws mounted on the base for movement by said stuffer means into engagement with opposite sides of a properly located connector during a termination operation.

6. The termination tool of claim 5 wherein said stuffer means has a driving portion for effecting said driving of the cable into the receptacle means of the connector and cam means for engaging and effecting movement of said clamping jaws against opposite sides of the connector.

7. The termination tool of claim 6 wherein said cam means comrises a pair of spaced apart cam portions for engaging said clamping jaws and driving the clamping jaws into engagement with the connector, said driving portion being disposed between the clamping jaws.

8. The termination tool of claim 5 wherein said clamping jaws are spring loaded and moved by said stuffer means toward the connector against the spring bias for a termination operation and are automatically returned to inoperative positions by the spring after the termination operation.

9. The termination tool of claim 8 including stop means for said clamping jaws defining the inoperative positions therefor.

10. The termination tool of claim 5 wherein said clamping jaws are pivotally mounted on said base.

11. The termination tool of claim 1 wherein said stuffer means has a driving portion for driving the cable into the receptacle means of the connector and cam means for engaging and effecting movement of said clamping means into engagement with the connector.

12. The termination tool of claim 1 wherein said connector includes aperture means, and said locator means comprises, in combination, upstanding locator pins positionable in said aperture means to properly position the connector for a termination operation.

13. The termination tool of claim 1 wherein said stuffer means is mounted for generally vertical reciprocating movement toward and away from said base and locator means, and said clamping means is mounted on said base for generally horizontal movement toward and away from the positioned connector.

14. The termination tool of claim 1 wherein said connector includes a stuffer block positionable within said receptacle means to hold a cable in electrical termination with the conductive contacts on the connector, said stuffer means includes, in combination, means for engaging said stuffer block into engagement with the cable, driving the stuffer blocks, and driving the cable into the connector.

15. The termination tool of claim 13 wherein said clamping means includes a pair of opposed clamping jaws mounted on the base for movement by said stuffer means into engagement with opposite sides of a properly located connector during a termination operation.

16. The termination tool of claim 15 wherein said clamping jaws are spring loaded and moved by said stuffer means toward the connector against the spring bias for a termination operation and are automatically returned to inoperative positions by the spring after the termination operation.

17. The termination tool of claim 16 wherein said stuffer means has a driving portion for effecting said driving of the cable into the receptacle means of the connector and cam means for engaging and effecting movement of said clamping jaws against opposite sides of the connector.

18. The termination tool of claim 17 wherein said cam means comprises a pair of spaced cam portions for engaging said clamping jaws to move the jaws generally horizontally inwardly toward each other in response to the vertical movement of the stuffer means toward the properly positioned connector, said driving portion being disposed between the clamping jaws.

19. The termination tool of claim 15 wherein said clamping jaws are pivotally mounted on said base.

20. A termination tool for assembling electrical cables, such as ribbon cables or the like, to an electrical connector which has receptacle means for receiving a cable in electrical termination with conductive contacts on the connector, comprising:

a base having locator means for properly locating a connector in position for receiving an electrical cable;

clamping means in the form of a pair of opposed clamping jaws pivotally mounted on said base for movement toward and away from opposite sides of a properly positioned connector to engage the connector and hold the connector in position during a termination operation, said clamping jaws being disposed on opposite sides of said locator means on the base;

stuffer means mounted on the tool for movement toward and away from said base and locator means to drive the cable into the receptacle means of the connector, said stuffer means including a driving portion for effecting said driving of the cable into the receptacle means of the connector and cam means for engaging said opposed clamping jaws and moving the jaws toward one another into engagement with the opposite sides of the connector; and spring means on said base operatively associated with said clamping jaws to bias the clamping jaws outwardly toward inoperative positions, said cam means being effective to move the clamping jaws against the spring bias for a termination operation and said clamping jaws being automatically returned by said spring means to their inoperative positions after the termination operation.

21. The termination tool of claim 20 wherein said cam means comprises a pair of spaced cam portions for engaging said clamping jaws and driving the clamping jaws into engagement with the connector, said driving portion being disposed between the clamping jaws.

22. The termination tool of claim 21, wherein said spaced cam portions are canted in relation to the direction of movement of said stuffer means and said clamping jaws.

23. The termination tool of claim 20 including stop means for said clamping jaws defining the inoperative positions thereof.

24. The termination tool of claim 20 wherein said connector includes aperture means, and said locator means comprises, in combination, upstanding locator pins positionable in said aperture means to properly position the connector for a termination operation.

25. The termination tool of claim 20 wherein said stuffer means is mounted for generally vertical reciprocating movement toward and away from said base and locator means, and said clamping jaws is mounted on said base for generally horizontal movement toward and away from the positioned connector.

26. The termination tool of claim 20 wherein said connector includes a stuffer block positionable within said receptacle means to hold a cable in electrical termination with the conductive contacts on the connector, and said stuffer means includes, in combination, means for engaging said stuffer block, driving the stuffer block into engagement with the cable and driving the cable into the connector.

* * * * *